US007092659B2

(12) United States Patent
Brenner

(10) Patent No.: US 7,092,659 B2
(45) Date of Patent: Aug. 15, 2006

(54) DISCHARGE METHODS AND SYSTEMS IN ELECTROPHOTOGRAPHY

(75) Inventor: Robert E. Brenner, New Richmond, WI (US)

(73) Assignee: Samsung Electronics Co., Ltd., Suwon (KR)

( * ) Notice: Subject to any disclaimer, the term of this patent is extended or adjusted under 35 U.S.C. 154(b) by 74 days.

(21) Appl. No.: 10/750,226

(22) Filed: Dec. 31, 2003

(65) Prior Publication Data

US 2005/0141922 A1 Jun. 30, 2005

(51) Int. Cl.
*G03G 15/02* (2006.01)

(52) U.S. Cl. ..... 399/170

(58) Field of Classification Search ..... 399/168, 399/169, 170, 171, 172, 116, 159, 162
See application file for complete search history.

(56) References Cited

U.S. PATENT DOCUMENTS

| | | | | |
|---|---|---|---|---|
| 4,166,967 | A | 9/1979 | Benes et al. | |
| 4,402,593 | A | 9/1983 | Bernard et al. | 399/159 |
| 5,028,779 | A | 7/1991 | Gundlach et al. | 250/325 |
| 5,164,779 | A | 11/1992 | Araya et al. | 399/176 |
| 5,208,635 | A * | 5/1993 | Reese et al. | 399/168 |
| 5,247,328 | A | 9/1993 | Daunton et al. | 399/170 |
| 5,466,551 | A | 11/1995 | Yuh et al. | 430/63 |
| 5,479,243 | A | 12/1995 | Kurokawa et al. | 399/159 |
| 5,517,289 | A | 5/1996 | Ito et al. | 399/149 |
| 5,537,189 | A * | 7/1996 | Imes | 399/116 |
| 5,557,375 | A | 9/1996 | Nagayasu et al. | 399/174 |
| 5,568,232 | A | 10/1996 | Kashihara | 399/175 |
| 5,771,424 | A | 6/1998 | Lindblad et al. | 399/71 |
| 5,805,962 | A | 9/1998 | Ko | 399/174 |
| 5,821,833 | A | 10/1998 | Lakin | |
| 5,921,544 | A * | 7/1999 | Benedict | 271/226 |
| 6,087,198 | A | 7/2000 | Panasik | |
| 6,127,077 | A | 10/2000 | Pai et al. | 430/58.7 |
| 6,160,980 | A | 12/2000 | Ziegelmuller et al. | 399/303 |
| 6,169,872 | B1 | 1/2001 | Thayer | 399/354 |
| 6,246,852 | B1 * | 6/2001 | Branch et al. | 399/171 |
| 6,333,755 | B1 | 12/2001 | Ehara et al. | 347/129 |

FOREIGN PATENT DOCUMENTS

| | | |
|---|---|---|
| JP | 57102669 | 6/1982 |

OTHER PUBLICATIONS

Lakin, K. M. et al., "Solidly Mounted Resonators and Filters", IEEE Ultrasonics Symposium, 1995, pp. 1-4, (4 pages).

Lakin K. M. et al., "High-Q Microwave Acoustic Resonators and Filters", IEEE Transactions on Microwave Theory and Techniques, vol. 41, No. 12, Dec. 1993, pp. 2139-2146, (8 pages).

(Continued)

*Primary Examiner*—Hoan Tran
(74) *Attorney, Agent, or Firm*—Mark A. Litman & Associates, P.A.

(57) ABSTRACT

Latent charge images are provided on a photoconductor element having a photoconductive layer with a conductive stripe. This process is performed by charging the photoconductive layer with a charge having a particular vector to form a uniform charge on the photoconductive layer; and subsequently charging the conductive stripe with a charge having a vector that is opposite the vector of the charge on the photoconductive layer to lower the charge content in the photoconductive layer. The first charge may be provided by a first corona charging device and the subsequent charge may be applied by a second corona discharge device focused on a conductive stripe.

15 Claims, 5 Drawing Sheets

OTHER PUBLICATIONS

Naik, Rajan S. et al., "Measurements of the Bulk, C-Axis Electromechanical Coupling Constant as a Function of AlN Film Quality," IEEE Transactions on Ultrasonics, Ferroelectrics, and Frequency Control, vol. 47, No. 1, Jan. 2000, pp. 292-296, (5 pages).

Mansfeld G. D. et al., "Theory and Numerical Analysis of Bulk Acoustic Wave Multilayer Composite Resonator Structure", IEEE Ultrasonics Symposium, Institute of Radioengineering and Electronics, Russian Academy of Sciences, Moscow, Russia, 1997, pp. 891-894, (4 pages).

Li, E. Herbert et al., "Genetic Algorithms for Reflective Filters Design", IEEE, 2001, pp. 9-12, (4 pages).

* cited by examiner

DISCHARGE METHODS AND SYSTEMS IN ELECTROPHOTOGRAPHY

BACKGROUND OF THE INVENTION

1. Field of the Invention

The present invention relates to the field of electrophotography, particularly electrophotography methods and apparatus. More particularly the present invention relates to the field of imaging with electrophotographic processes wherein photoconductive substrates are charged, imagewise discharged, toned, imaged (e.g., with fusion or transfer) and recharged, usually with an intermediate charge cleaning or discharge step (intermediate of the imaging and recharge step) that is typically an electromechanical connection 2. Background of the Art An electrophotographic printing apparatus such as a copy machine or a printer produces electrostatic latent images on a photosensitive drum by converting digital signals corresponding to image data generated from a computer or a copy of an original document into light signals. The signals are sent through an exposure device, and then printed by fixing a toner on paper. A developing cartridge of the electrophotographic printing apparatus is an assembly of charging, exposing, developing, and transferring mechanisms that exposes image data on the photosensitive drum, supplies toner to the exposed portion, and transfers toner images to print media.

Generally, as a unit for charging the surface of the photosensitive drum, a contact-type charging roller as disclosed, for example, in U.S. Pat. No. 5,164,779 for Image Forming Apparatus With Dual Voltage Supplies For Selectively Charging And Discharging An Image Bearing Member issued to Araya et al., U.S. Pat. No. 5,247,328 for Method And Apparatus For Charging A Photoconductive Surface To A Uniform Potential issued to Daunton et al., U.S. Pat. No. 5,479,243 for Image Forming Apparatus And Charging Device Thereof issued to Kurokawa, U.S. Pat. No. 5,517,289 for Apparatus for And Method Of Forming Image issued to Ito et al., U.S. Pat. No. 5,557,375 for Contact Type Charging Device And Image Forming Apparatus Having The Same issued to Nagayasu et al., and U.S. Pat. No. 5,568,232 for Image Forming Apparatus Capable Of Removing Toner Fragments And Shavings From A Contact Charging Device By Supplying A Voltage To An Image Carrier To Which The Fragments And Shavings Are Attracted issued to Kashihara, using a so-called contact (or direct) charging scheme or a corona wire using a corona discharging scheme may be used to produce an uniform electric field in response to application of high voltage for charging the surface of the photosensitive drum to a constant potential to attract toner particles and thereby form the latent image on the photosensitive drum. Typically, a charging unit is charged at the start of a printing operation. The surface of the photosensitive drum is charged and a developing unit is concurrently charged by way of the charging unit as the photosensitive drum rotates in a direction opposite to the rotation of the developing unit. As a result, an electrostatic latent image is formed on the photosensitive drum and the latent image is then visualized as a toner image by the developing unit. The charged area of the photosensitive drum is then exposed to a laser beam. Because of the potential difference between the exposed area and the unexposed area of the photosensitive drum, the toner particles are attracted only to the exposed area to form the toner image on the photosensitive drum. The toner image is then transferred to the recording medium. After the toner image is transferred to the recording medium, the photosensitive drum is charged back to an original voltage as the recording medium is being conveyed to a fixing unit. A common problem in contemporary charging units is that toner supplied from the developing unit often sticks on an unexposed area of the photosensitive drum in the vicinity of the edges of the recording medium, so that contamination occurs.

U.S. Pat. No. 5,805,962 describes a charging device of an electrophotography printing apparatus that improves the charging efficiency by preventing the potential difference generated at both ends of a photosensitive drum. An auxiliary charging device includes an auxiliary charging plate to which voltage is applied. The plate is installed to come into contact with both ends of the photosensitive drum in order to compensate for a potential level in a developing cartridge. The electrophotography printing apparatus may include a charging unit, a developing unit and a toner supplying unit provided around the photosensitive drum.

U.S. Pat. No. 6,160,980 describes a method and apparatus for transferring a toner image to a receiver sheet having an endless belt that is mounted for movement in a direction along a lengthwise dimension of the belt and through an endless path. The belt includes a splice seam that occurs transverse to the direction of movement of the belt, the seam having a discontinuity into which toner tends to collect which is free to transfer. The seam includes a bump proximate each end of the splice seam which extends above the seam. A rotatable member rotates while in engagement with a surface of the belt so as to urge a receiving sheet into intimate engagement with the surface between the rotatable member and the belt. The bumps support the rotatable member out of engagement with the splice seam to substantially preclude transfer to the rotatable member of toner accumulating in the splice seam between the bumps. Receiver members are sent to a fusing station (not shown) to fuse or fix the dry toner images to the receiving member. The belt is reconditioned by providing charge to both surfaces using, for example, opposed corona chargers, transport web conditioning chargers, which neutralize charge on the surfaces of the belt.

U.S. Pat. No. 5,028,779 describes a miniature coronode (which is believed to be a corona electrode) charging device comprising a plurality of coronode wires that are slanted with respect to the direction of travel of a charge receptor in order to reduce the effective distance between "hot spots" in the wires and thereby insure uniform charging of the receptor. The length of coronode wires between support points and their conducting contacts is very small, thereby eliminating sagging, singing, tensioning and capacitance problems when providing a corotron charging device of unlimited length. Individual high impedance to the plurality of coronode wires is provided in order to limit the amount of current passing to each of the wires from a high voltage source and thereby reduce the possibility of arcing and damages to the charge receptor. Spacing between coronoa wires and the charge receiving surface is small to provide low corona threshold and self-limiting charging. Invariably, after the copy sheet is separated from photoconductive surface, some residual toner particles remain adhering thereto. Those toner particles are removed from photoconductive surface at the cleaning station. the cleaning station includes a corona generating device (not shown) adapted to neutralize the remaining electrostatic charge on photoconductive surface and that of the residual toner particles. The neutralized toner particles are then cleaned from photoconductive surface by a rotatably mounted fibrous brush (not shown) in contact therewith. Subsequent to cleaning, a discharge lamp (not shown) floods photoconductive surface with light to dissipate any residual electrostatic charge remaining thereon prior to the charging thereof for the next successive imaging cycle.

In the art of electrophotography, it has been found that consistent reproductive quality can only be maintained when a uniform and constant charge potential is applied to the photoconductive surface. In many automatic machines of this type, a single wire generator, generally referred to as a "corotron" is employed. Generally, the efficiency of the corotron is dependent on many factors including the gap distance between the wire and the photosensitive member surface, the nature of the generating wire material, the diameter of the wire and other physical features thereof, whether the system is using a positive or negative charging system, and the amount of energy supplied to the corona emitter. Heretofore, these corona devices required large power supplies to meet high current and voltage requirements, were costly and took up a large area of machine space. Such units are designed for use with thin (90 micrometer) wire or wires located approximately 2 to 10 mm from a grounded photosensitive member or shield. Typically, for charging speeds near 10.1 cm/sec corona wire voltages for charging are near 7 kV (between 2–10 kV) with a bare plate receiver current for a 40 cm long wire (which may be between 10–80 cm). The cross sectional area of such a unit is near 6 $cm^2$. As Neblette's Handbook of Photography and Reprography states in the Seventh Edition published in 1977, page 348, "In practical corotron devices the wires are maintained at a potential above 600 V, usually charging the photoconductor surface to several hundred volts". These units were adequate in the past, but with present need for copiers that emit less ozone, use less energy, are less costly and take up less space, changes in corona generating devices are required. This was thought to be impossible because conventional thinking on corona generators and experience had taught that reducing the cavity partly surrounding the corotron and bringing the corotron closer to a receiver surface would cause arcing to occur and burn out the wire corotron and damage the photoreceptor. Also, it was thought that the use of long thin wires (0.0015") and small radius cavities would cause singing and sagging in the wires.

U.S. Pat. No. 6,333,755 describes an electrophotographic apparatus includes a photosensitive body and electrostatic image forming device for forming an electrostatic image on the photosensitive body. The electrostatic image forming device includes an exposing device for exposing the photosensitive body by a digital light in accordance with image information. The exposing device exposes a portion that is a background for an image. A developing device develops the electrostatic image using a developer, wherein a rate throughout the developer of the contained particles have a diameter equal to or smaller than 1 millimicron is 5 to 40 number %, and wherein, when A denotes a one-pixel width and Wv denotes a width at half value of a peak in a potential distribution of the electrostatic image formed by exposing the photosensitive drum using the digital light of one pixel is satisfied. A fur brush device was constituted by a support shaft on which a brush was mounted as the charge/discharge contact.

U.S. Pat. No. 6,169,872 describes an electrically biased cleaning belt brush that removes oppositely biased particles from a surface. The belt brush, which is entrained about supporting members, includes a substrate to which is attached a multiplicity of conductive brush fibers. Particles adhering to the conductive fibers are removed from the brush fibers at a detoning station. The cleaning belt brush is biased to alternating regions of positive and negative polarities.

U.S. Pat. No. 6,127,077 describes a photoreceptor having a substrate, including: (a) a charge generating layer; (b) a first charge transport layer having a first charge carrier mobility value; and (c) a second charge transport layer having a second charge carrier mobility value, wherein the first charge transport layer is closer to the charge generating layer than the second charge transport layer and the second charge transport layer is contiguous to the first charge transport layer, wherein the second charge carrier mobility value is higher than the first charge carrier mobility value.

Other layers may also be used such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and may comprise conductive particles dispersed in a film forming binder. Other ground strips are simply created by an absence of a dielectric or photosensitive material, such as a bare area around the circumference of an aluminum drum, or with a band of conductive substrate exposed on a photoconductor belt. Some photoconductive belts and drums are made by coating the photoconductive material on a conductive substrate, such as PET (polyethylene) that is vapor-coated with aluminum or another conductor, that is seamed to form an endless belt or fixed to a drum.

U.S. Pat. No. 5,771,424 describes a preconditioning process and dual electrostatic brush cleaning apparatus for reducing adhesion of toner particles on the photoreceptor surface such that cleaning of the photoreceptor is enhanced. Preconditioning of the brush and/or the photoreceptor in the cleaning apparatus allows for cleaning of dual polarity toners, CAD toners and DAD toners. The preconditioning of the brush does not need replenishing once the print operation begins due to the electrostatics that maintain a constant predetermined level of toner in the brush. (The process direction is indicated by the arrow 16, photoreceptor edges by 170, and the ground strip by 160.) The preconditioning continues until the predetermined mass of black toner is held in the brush fibers of the first conductive brush. Once the first conductive brush has been preconditioned, the brush does not require further toner replenishing throughout the printing run.

U.S. Pat. No. 5,466,551 describes an electrostatographic imaging member comprising: (a) a supporting substrate including an electrically conductive surface; (b) at least one electrostatographic imaging layer; and (c) an electrically conductive grounding layer adjacent to the at least one imaging layer. In order to properly image an electrostatographic imaging member, the conductive layer must be brought into electrical contact with a source of fixed potential elsewhere in the imaging device. This electrical contact must be effective over many thousands of imaging cycles in automatic imaging devices. Since the conductive layer is frequently a thin vapor deposited metal, long life cannot be achieved with an ordinary electrical contact that rubs directly against the thin conductive layer. One approach to minimize the wear of the thin conductive layers is to use a grounding brush such as that described in U.S. Pat. No. 4,402,593. However, such an arrangement is generally not suitable for extended runs in copiers, duplicators and printers. The reference describes background art for improving electrical contact between the thin conductive layer of flexible electrostatographic imaging members and a grounding means by using a relatively thick electrically conductive grounding strip layer in contact with the conductive layer and adjacent to one edge of the photoconductive or dielectric imaging layer. Generally the grounding strip layer comprises opaque conductive particles dispersed in a film forming binder. This approach to grounding the thin conductive layer increases the overall life of the imaging layer because it is more durable than the thin conductive layer. However, such a relatively thick grounding strip layer is still subject to erosion which contributes to the formation of undesirable "dirt" in high volume imaging devices. Erosion is particularly severe in electrographic imaging systems utilizing metallic grounding brushes or sliding metal contacts.

Also described in systems utilizing a timing light in combination with a timing aperture in the grounding strip layer for controlling various functions of imaging devices is the erosion of the grounding strip layer by devices such as stainless steel grounding brushes and sliding metal contacts is frequently so severe that the grounding strip layer is worn away and becomes transparent thereby allowing light to pass through the grounding strip layer and creating false timing signals which in turn can cause the imaging device to prematurely shut down. Moreover, the opaque conductive particles formed during erosion of the grounding strip layer tends to drift and settle on other components of the machine such as the lens system, corotron, other electrical components, and the like to adversely affect machine performance. For example, at a relative humidity of 85 percent, the grounding strip layer life can be as low as 100,000 to 150,000 cycles in high quality electrophotographic imaging members. Also, due to the rapid erosion of the grounding strip layer, the electrical conductivity of the grounding strip layer can decline to unacceptable levels during extended cycling.

SUMMARY OF THE INVENTION

In an electrophotographic imaging system or any other electrostatic imaging system where images are formed by charging a surface, imagewise discharging the surface and applying toner to the surface to form a latent, intermediate or final image, and then the surface is recharged to provide additional imaging capability, a non-contact grounding system is used. A conductive edge on a photoconductive element used in the imaging process is ionically charged to control the level of charge on the element, preferably to alter the charge on the conductive element to the charge level desired before the recharging is effected. The ionic charging is preferably provided by a separate corona-type charging element that follows the sequence (and location) of the primary charging system and the toner station. A conductive strip is preferably provided on an edge of the photoconductive element so that a small secondary corona-type charging device may be positioned to overlay the conductive strip. By charging the strip, the charge on the photoconductor may be balanced or neutralized.

DETAILED DESCRIPTION OF THE INVENTION

An important consideration to remember in the field of electrophotography is the fact that it is necessary to electrostatically clean the surface on which the latent charge image is formed in between imaging process steps. If the surface is not cleaned and evenly recharged, spurious charging, and hence spurious imaging, will remain on that surface. It is not necessarily sufficient to merely recharge the surface with the primary corona device, as the remaining charge distribution will leave a background latent image of charge, to which would be added a uniform additive amount of ionic charging. This would be insufficient quality for most commercial uses. It is therefore at least desirable to clean the static charging on the surface (bringing the charge to a uniform distribution as close to zero as possible) before the primary corona charging system adds the overall uniform charge to the photoconductor surface.

A method may be performed to provide latent charge images on a photoconductor element having a photoconductive layer with a conductive stripe. The method may comprise charging the photoconductive layer with a charge having a particular vector to form a uniform charge on the photoconductive layer; and subsequently charging the conductive stripe with a charge having a vector that is opposite the vector of the charge on the photoconductive layer to lower the charge content in the photoconductive layer. By vectors is meant positive or negative charges, each charge being a vector opposite the other charge.

Figure 1:
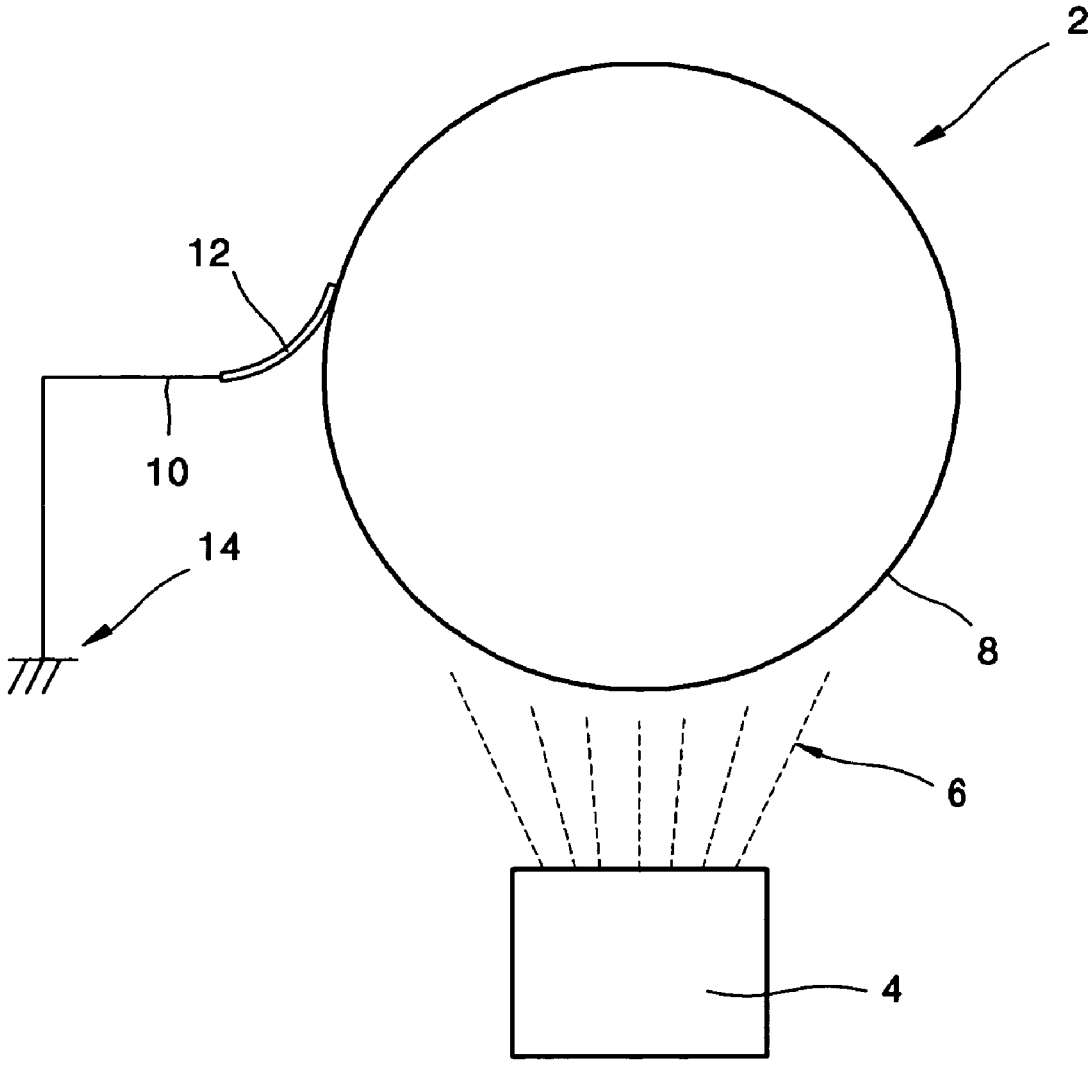
FIG. 1 (PRIOR ART)
FIG. 1 shows a schematic drawing of prior art grounding systems on a roller drum

FIG. 1 shows a prior art system of effecting discharging on an electrostatic drum 2. The drum 2 is associated with a corona device 4 which sends a spray of ions 6 against the surface 8 of the drum 2. After exposure, toning and transfer from the drum surface 8, a ground wire 10 makes contact with the edge of the drum 2 at a point 12 beyond the toner transfer. The ground wire 10 is connected to ground 14. This system requires physical contact between the wire 10 and the edge point 12 of the drum 2, which enables significant wear on the drum 2 edge.

Figure 2:
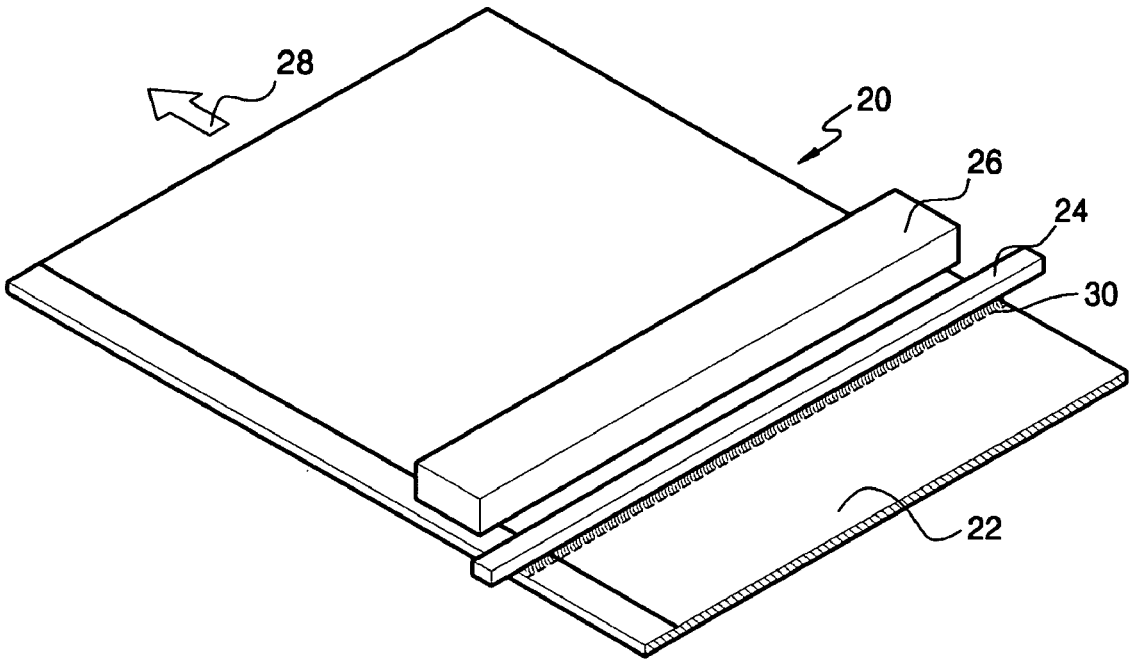
FIG. 2 (PRIOR ART)
FIG. 2 shows a schematic of a prior art grounding system for a sheet or belt photoconductor.

FIG. 2 shows a sheet of endless belt 20 photoconductive element having an imaging surface 22. An erasure bar 24 contacts the photoconductive imaging surface 22 before the surface 22 passes under the corona device 26. As the photoconductive element 20 moves in direction 28, the erasure bar 24 (which is a physical brush or bar) contacts the surface 22 and draws off any residual charge. Again, the bar 24 is in physical contact with the surface 22 along line 30, directly under the bar 24 and the physical contact can abrade the surface 22.

Figure 3:
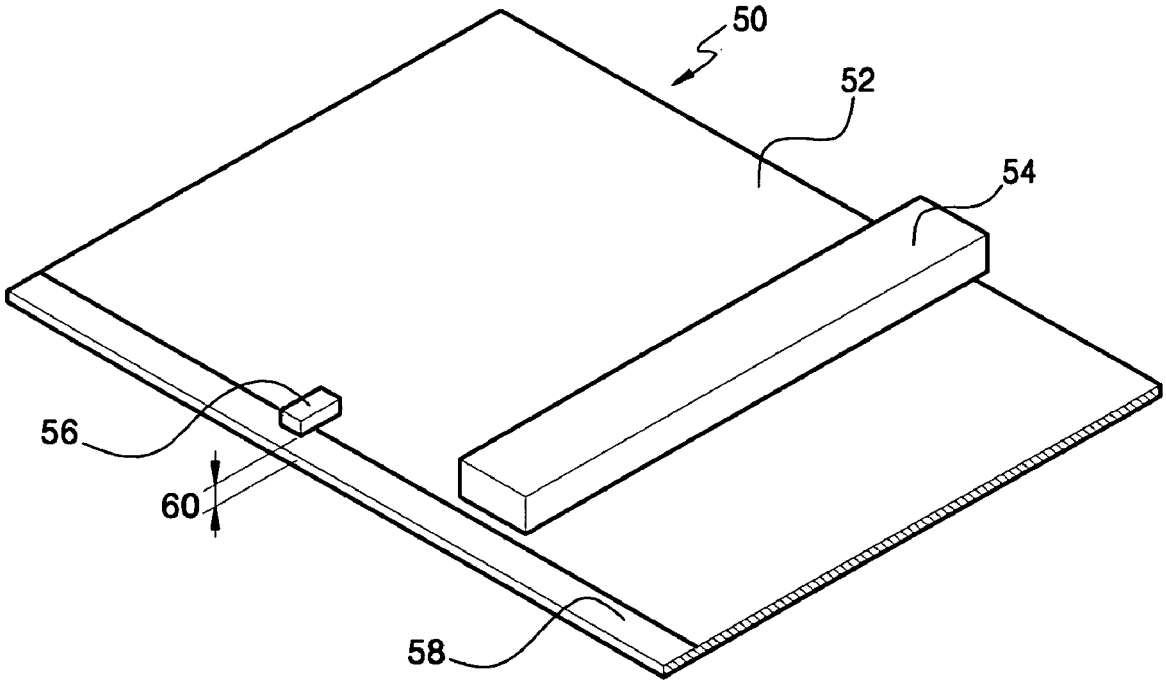
FIG. 3 shows a schematic of a non-contact grounding system according to the practice of the present invention.

FIG. 3 shows a system 50 construction according to one aspect of the present invention. The system 50 comprises the photoconductor element 52 (which may be a belt or drum, but which is shown here in this non-limiting example as a belt), the primary surface charging corona device 54, the secondary corona device 56, the conductive stripe 58 which is separated from the photoconductor element 52 by a distance 60. The second corona device 56 overlays the conductive stripe 58 and does not extend significantly over (if at all) the remainder of the photoconductor element 52. When the primary corona device 54 applies a positive charge, the secondary corona device 56 would apply negative ions to the conductive stripe 58. Similarly, if the primary corona applies negative ions, the secondary corona device 56 would apply positive ions. The intervening imaging and toning stations are not shown for the convenience and simplicity of the figures.

Figure 4:
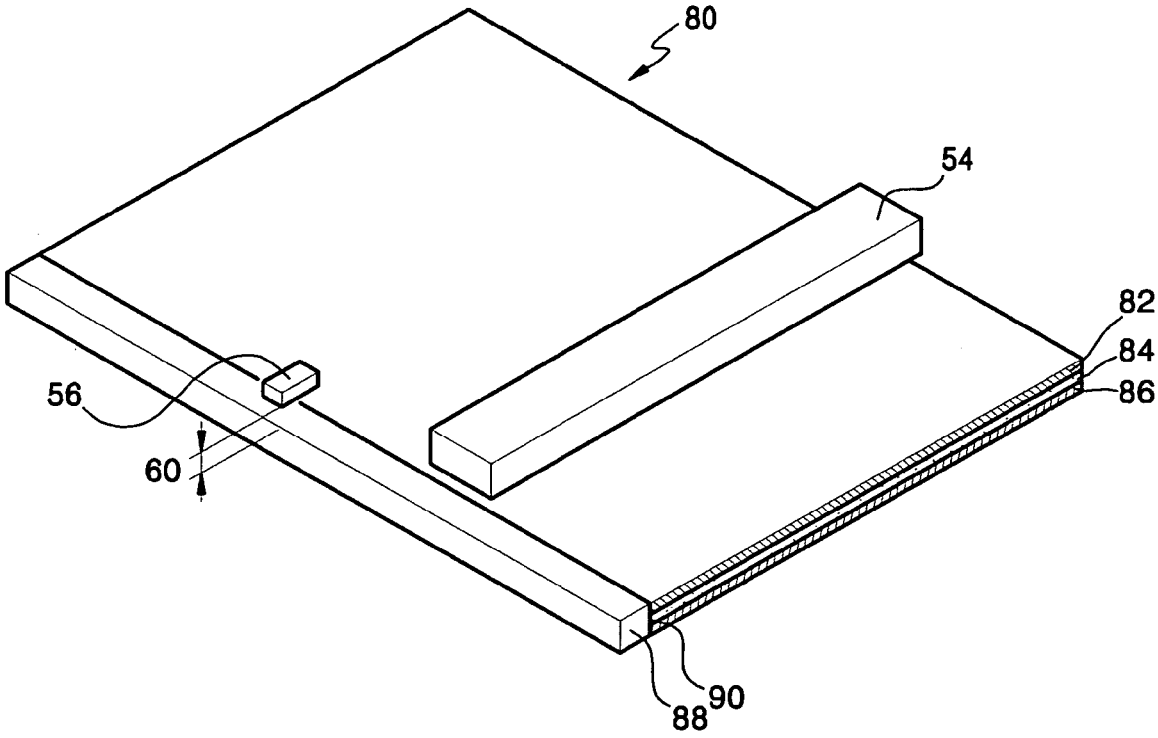
FIG. 4 shows a perspective view of an electrophotographic sheet with the edge corona device of the invention.

FIG. 4 shows a perspective edge view of a conductive sheet 80 (which may be a drum surface, sheet or endless belt) comprising a photoconductive top layer 82, a conductive intermediate layer 84 and a dielectric support layer 86. A conductive stripe 88 is shown as a complete element 88 in electrical contact with the three layers 82, 84 and 86, although it may be only a thin stripe coated on top of the photoconductive layer and possibly around the edge 90 formed by the three layers 82, 84 and 86. In a cutaway section, the secondary corona device 56 and its spacing 60 from the conductive stripe 88 are shown.

Figure 5:
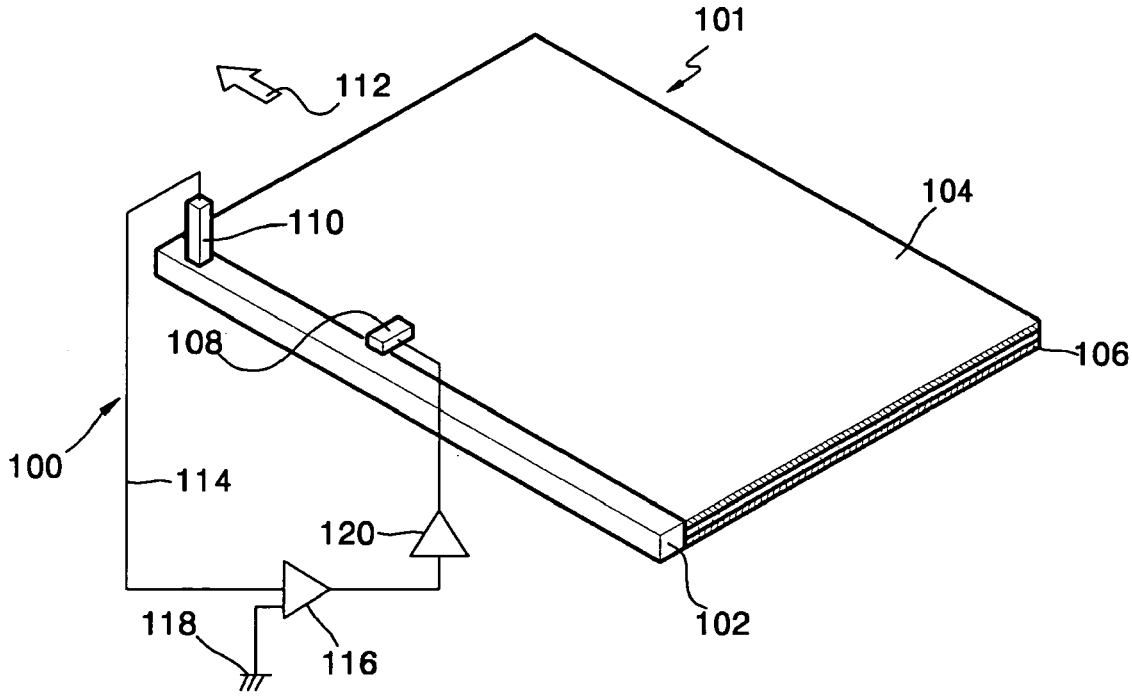
FIG. 5 shows a perspective of an electrophotographic sheet with the edge corona device of the invention and the ground measurement.

In order to ascertain that the conductive stripe is maintained at a reference voltage (in this case, as close as possible to zero volts (0V) is preferred), additional electronic servo hardware may be employed to monitor the surface potential and adjust the voltage (or current) of the second corona charging device. FIG. 5 shows one embodiment of such a monitoring/adjusting system 100. FIG. 5 shows a side view of a photoreceptor belt 101 (having the same construction as that shown in FIG. 4) having a front surface 104 and a back surface 106. The second corona charging device 108 is positioned over the conductive stripe 102. The monitoring/adjusting system 100 may comprise an electrostatic probe 110 positioned (preferably, as close as possible) over the surface of the conductive stripe 102, down stream of the second corona charging device 108. (In this illustration the photoreceptor 101 is moving in a direction shown by arrow 112). The monitoring and adjusting system 100 then comprises an electrical path 114 for the signal transmitted from the electrostatic probe 110 which is then sent to an error amplifier 116. The error amplifier 116 then compares the signal from the electrostatic probe 110 with reference data 118 (in this case, ground or 0V). The signal then leaves the error amplifier 116 and is sent to a high voltage amplifier 120 that sends the appropriate voltage or current of the correct polarity to the second corona charging device 108, to maintain the voltage at the desired potential (in this case, as close to 0V as possible).

The primary charge corona devices ordinarily comprise a conductive shield, which is preferably grounded, and one or more transversely extending corona wires within the circumference of the shield. The charged portion of the photoconductor then moves through an exposure station underneath the ionic path of discharge of the corona device. There, the surface of the photoconductor is exposed to a flowing optical image of an original document, produced by an optical scanning system, to discharge the surface selectively in a pattern corresponding to the graphic matter on the document. The secondary corona device of the present invention need only be different in size. Additionally, the fact that the stripe is conductive allows the corona wire to be used without a shield, as the conductive stripe itself may act as a shield.

The conductive stripe may, as previously noted, be a distinct edge layer on the photoconductive element, or may be a thin coating that overlays only the top layer of the photoconductor or overlays the top layer and forms an edge layer on the photoconductive element (e.g., it forms an L extending over the entire edge and a small distance over the surface of the photoconductor layer). The conductive stripe may be any material with sufficient conductivity as to draw charge or relay charge to the photoconductive top layer. Such materials as vapor deposited metal stripes (e.g., aluminum, copper, silver gold, etc.), conductive particle filled polymeric resins (e.g., metal particle filled, carbon black filled, etc.), or conductive polymer layers (e.g., polymers having sufficient numbers of conductive groups such as quaternary nitrogen groups) can be used. Because the stripe has minimal physical requirements (as it is not being contacted by a physical element while it is moving, very inexpensive materials, such a carbon black filled polymer, can be used for the stripe.

The method may also include, as described herein a series of process steps wherein the ground strip voltage is sensed by measuring the surface potential of the ground strip at a point downstream of the second corona charging device to provide a signal, sending the signal to an error amplifier, comparing the measured surface potential with a reference surface potential to provide a resulting comparison, sending the resulting comparison to a high voltage amplifier, sending a charge to the second corona charging device of sufficient potential based upon the resulting comparison to alter the sensed ground strip voltage in a correct vector, and applying positive or negative ions to the ground strip to provide a potential close to zero volts. In the system, the second corona charging device does not have to include the use of a shield integral to a wire in the second corona discharge device, as noted above.

Although specific examples of the structures and materials of the invention have been described in the disclosure of the present invention, these specific embodiments are not intended to be limiting descriptions of the invention. Rather, the specific materials, structures and steps (including their sequences) are intended to exemplify the generic practices of the invention and all known equivalent and alternative practices within the art are included within the contemplation of the present invention.

What is claimed:

1. A system for providing electrophotographic latent images on a photoconductive element having a conductive stripe that is in contact with a photoconductive layer on one edge of the photoconductive element comprising:

a first corona charge device positioned to charge the photoconductive layer; and a second corona charge device positioned to charge the conductive stripe with a charge that is opposite a charge provided by the first corona charge device.

2. The system of claim 1 having an optical imaging system between the first corona charge device and the second corona charge device.

3. The system of claim 2 having a charge toning device between the first corona charge device and the second corona charge device.

4. The system of claim 3 wherein the photoconductive element comprises an endless belt or a drum.

5. The system of claim 2 wherein the photoconductive element comprises an endless belt or a drum.

6. The system of claim 1 having a charge toning device between the first corona charge device and the second corona charge device.

7. The system of claim 6 wherein the photoconductive element comprises an endless belt or a drum.

8. The system of claim 1 wherein the photoconductive element comprises an endless belt or a drum.

9. The system of claim 1 wherein the second corona charge device is positioned between 2–10 mm from the conductive stripe of the photoconductive layer.

10. The system of claim 1 wherein the second corona charge device does not include the use of a shield integral to a wire in the second corona charge device.

11. A method of providing latent charge images on a photoconductive element having a photoconductive layer with a conductive stripe, the method comprising:

charging the photoconductive layer with a charge having a particular vector to form a uniform charge on the photoconductive layer; and subsequently charging the conductive stripe with a charge having a vector that is opposite the vector of the charge on the photoconductive layer to lower the charge content on the photoconductive layer.

12. The method of claim 11 wherein a portion of the uniform charge is dissipated by exposure to radiation prior to the subsequent charging of the conductive stripe.

13. The method of claim 12 wherein the photoconductive layer is toned with an electrophotographic toner prior to the subsequent charging of the conductive stripe.

14. The method of claim 11 wherein the photoconductive layer is toned with an electrophotographic toner prior to the subsequent charging of the conductive stripe.

15. The method of claim 11 further comprising:

sensing a ground stripe voltage by measuring the surface potential of the ground stripe at a point downstream of a second corona charging device to provide a signal, sending the signal to an error amplifier, comparing the measured surface potential with a reference surface potential to provide a resulting comparison, sending the resulting comparison to a high voltage amplifier, sending a charge to the second corona charging device of sufficient potential based upon the resulting comparison to alter the sensed ground stripe voltage in a correct vector, and applying positive or negative ions to the ground stripe to provide a potential close to zero volts.

* * * * *